US006972670B2

(12) United States Patent
LaDuc et al.

(10) Patent No.: US 6,972,670 B2
(45) Date of Patent: Dec. 6, 2005

(54) WDP SETUP DETERMINATION METHOD

(75) Inventors: John LaDuc, Harrisville, NY (US); Jon M. Marra, Henderson, NY (US); Dale R. Stevens, Adams Center, NY (US); Joseph Mario Nazareth, Rockledge, FL (US); Bryan David Cain, Rockledge, FL (US)

(73) Assignee: New York Air Brake Corporation, Watertown, NY (US)

( * ) Notice: Subject to any disclaimer, the term of this patent is extended or adjusted under 35 U.S.C. 154(b) by 70 days.

(21) Appl. No.: 10/726,659

(22) Filed: Dec. 4, 2003

(65) Prior Publication Data

US 2005/0125112 A1 Jun. 9, 2005

(51) Int. Cl.[7] ..... B60Q 1/00
(52) U.S. Cl. ..... 340/438; 340/310.01; 303/7
(58) Field of Search ..... 340/438, 502, 340/503, 504, 505, 310.01, 310.02, 310.07, 340/310.08; 303/3, 7, 15, 16; 701/19

(56) References Cited

U.S. PATENT DOCUMENTS

| | | | | |
|---|---|---|---|---|
| 4,774,669 | A * | 9/1988 | Schmitz et al. | 701/117 |
| 4,955,304 | A * | 9/1990 | Spenk et al. | 104/296 |
| 5,862,048 | A * | 1/1999 | Knight | 700/9 |
| 5,984,427 | A * | 11/1999 | Kettle, Jr. | 303/16 |
| 6,334,654 | B1 * | 1/2002 | Root et al. | 303/7 |
| 6,456,937 | B1 | 9/2002 | Doner et al. | 701/213 |
| 6,587,764 | B2 * | 7/2003 | Nickles et al. | 701/19 |
| 6,648,422 | B2 * | 11/2003 | Root et al. | 303/7 |
| 2003/0151520 | A1 | 8/2003 | Kraeling et al. | |
| 2003/0213875 | A1 | 11/2003 | Hess, Jr. et al. | |

FOREIGN PATENT DOCUMENTS

| | | |
|---|---|---|
| EP | 1 010 602 A1 | 12/1999 |
| WO | WO 99/38743 | 8/1999 |
| WO | WO 02/22425 A1 | 3/2001 |

OTHER PUBLICATIONS

Hoerl F et al. "Mehrfachfunkfernsteuerung Von Lokomotiven IM Zugverband Multiple Radio Remote Control of Locomotives in Coupled Trains Telecommande Multiple Par Radio D'Engins Dans Le Train" Elektrische Bahnen, Oldenbourge Verlad. Munchen, DE, vol. 100, No. 3 (Mar. 2002-2003), pp. 105-109.

* cited by examiner

*Primary Examiner*—Van T. Trieu
(74) *Attorney, Agent, or Firm*—Barnes & Thornburg LLP

(57) ABSTRACT

A method of determining the configuration of locomotives in wired distributed trains. It includes determining consists of adjacent locomotives in the train. It determines one or more sub-consists of adjacent locomotives, which are controlled separately from a preceding adjacent locomotive within the consist. Locomotives which have an available wired distributed power controller is determined. A common consist indicator is assigned to all adjacent locomotives of a consist if the consist has at least one available wired distributed power controller. A common sub-consist indicator is assigned to all locomotives of a sub-consist if the consist has at least one available wired distributed power controller.

21 Claims, 4 Drawing Sheets

WDP SETUP DETERMINATION METHOD

BACKGROUND AND SUMMARY

The present method is directed to determining the configuration of locomotives in a train and more specifically determining configuration of locomotives in a wired distributed power train which is also an electrically-controlled pneumatic train.

Although references will be made herein to specifications of the Association of American Railroads (AAR), the present system may be used on other trains which do not operate or are required to meet the AAR specifications discussed herein or any other AAR specifications. Reference is made to the following AAR specifications:

S-4200 "Performance Requirements for ECP Cable-Based Freight Brake Systems;"

S-4230 "Intra-Train Communications Specification for Cable Based Freight Train Control Systems;" and S-4250 "Performance Requirements for the ITC Locomotive Controlled Cable Based Distributed Power Systems."

An electrically controlled pneumatic (ECP) train is a train that is equipped with a intra-train communication (ITC) network linking brake control devices installed on cars and locomotives (vehicles) throughout the train. The primary function of the ECP system is to provide control and monitoring of train braking, as detailed in AAR S-4200 and AAR S-4230.

A wired distributed power (WDP) train is a train that is equipped with locomotive control modules (LCMs) that provide the ability to control the traction and brake systems on remotely located locomotives via the ITC network. The primary function of the WDP system is to provide control and monitoring of locomotive traction and braking, as detailed in AAR S-4250 and AAR S-4230.

The ECP makeup and sequencing process are the methods through which all ECP devices present in the train and their physical positions of ECP devices in the train are determined, as detailed in AAR-4200 and AAR S-4230. The WDP makeup process is the method through which all WDP devices present in the train are determined, as detailed in AAR S-4230 and AAR S-4250. These devices may include LCMs.

While a consist is physically adjacent locomotives, a multiple unit (MU) consist is a continuous block of physically adjacent locomotives that have been tied together by coupling the intra-locomotive electrical cables and pneumatic hoses thereby allowing the traction and braking of all locomotives in the consist to be controlled as one combined unit. An MU Controlled unit is a locomotive that receives its standard locomotive commands from the MU cables and hoses.

The following is an excerpt from AAR S-4250, Section 2, Assumptions:

An ITC equipped locomotive shall be capable of operating as either an ITC Lead locomotive, or an ITC Controlled locomotive. An ITC equipped locomotive may also be capable of operating as an ITC Monitored locomotive.

All locomotives in an ITC Controlled train must be equipped with an ITC communication through-cable at a minimum.

All MU connections are made between locomotives within a consist. Only one locomotive in the train shall be an ITC Lead locomotive which shall be the first locomotive in the lead consist. Only one locomotive in a remote consist will be ITC Controlled. The remainder of the locomotives in the lead or remote consists will be primarily controlled through the MU electrical cables and pneumatic hoses and shall be identified as either MU Controlled or ITC Monitored locomotives. Additionally, some functions of these locomotives may be controlled via the ITC Network.

The following is an excerpt from AAR S-4250, Section 4.5.2.4, Entering WDP Mode Summary:

The WDP Make-up and Linking processes shall occur in System NIT Mode.

a. The Lead LCM shall query the network to identify all Remote LCMs. When the Remote LCMs have been identified, they shall be assigned network addresses and shall be added to the Lead LCM database.

b. The Lead LCM shall establish the version compatibility level of the LCMs within the train per S-4230, latest revision.

c. Each Remote LCM shall provide Locomotive specific data, per S-4230, latest revision, to the Lead LCM.

d. The Lead LCM shall determine each ITC equipped locomotive's consist designation, shall designate one locomotive in each consist as an ITC Controlled unit and the others as ITC Monitored units and shall identify the ITC Lead unit requested remote orientation, if ECP Sequencing data is provided.

e. The Lead LCM shall prompt the operator to confirm or enter each remote locomotive's orientation, consist designation and configuration type (ITC Controlled or ITC Monitored) correlated to the locomotive identification number. If a discrepancy is found, the discrepancy shall be resolved against the actual train configuration by the operator. The Lead MMI shall provide the operator the means to correct/modify these discrepancies. The WDP system may use ECP Sequencing data to assist in the automation of the WDP Set-up and Make-up Processes. The WDP System shall not allow the locomotive identification number to be modified.

The present method determines the configuration of locomotives in wired distributed trains. It includes determining consists of adjacent locomotives in the train. It determines one or more sub-consists of adjacent locomotives, which are controlled separately from a preceding adjacent locomotive within the consist. Locomotives which have an available wired distributed power controller is determined. A common consist indicator is assigned to all adjacent locomotives of a consist if the consist has at least one available wired distributed power controller. A common sub-consist indicator is assigned to all locomotives of a sub-consist if the consist has at least one available wired distributed power controller.

The position of cars and locomotives in the train is determined and used to determine consists of adjacent locomotives. The position in the train is determined automatically by determining the sequence of nodes connected to a wire network. Orientation of the locomotives is also determined during the sequencing operation and subsequently compared to reported orientation. The two orientations are compared, and the differences are flagged.

A locomotive not controlled by a preceding adjacent locomotive, which is defined as a sub-consist, is determined by comparing locomotive compatibility of adjacent locomotives. Independent wired distributed power control of less than all sub-consists in a consist is prevented in response to an independent control request.

These and other aspects of the present method will become apparent from the following detailed description of the method, when considered in conjunction with accompanying drawings.

DETAILED DESCRIPTION OF THE PREFERRED EMBODIMENTS

Figure 1:
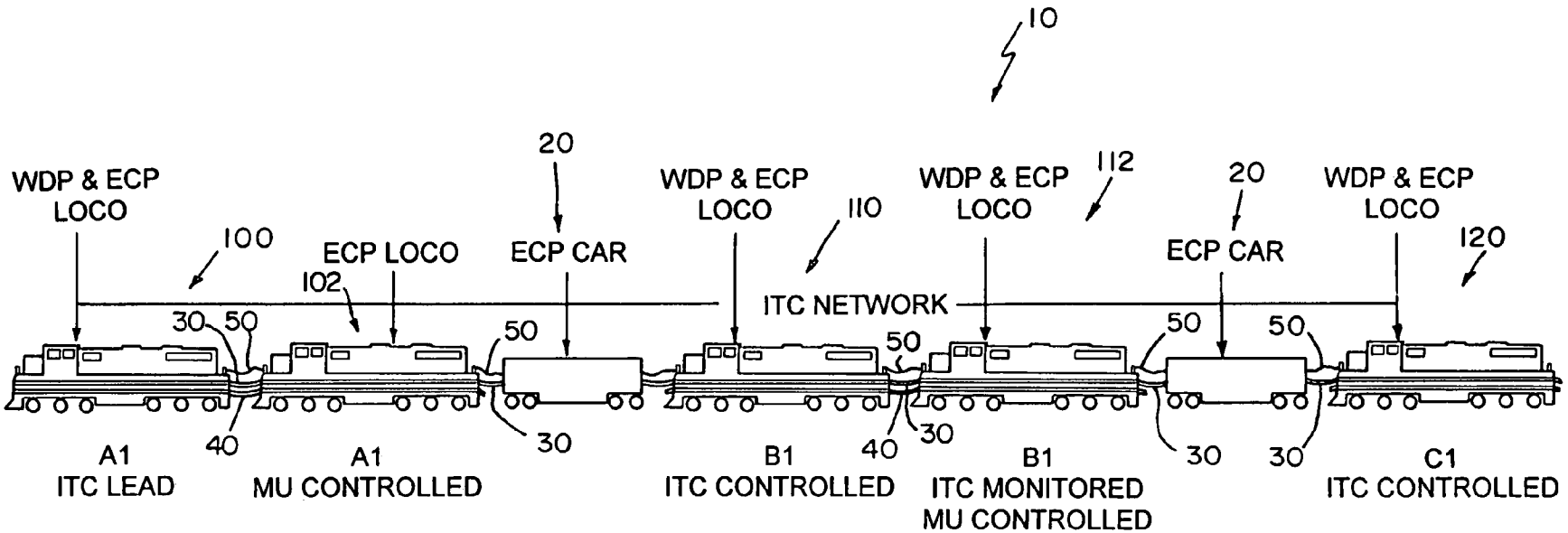
FIG. 1 is a diagram of a train having wired distributed power and electrically-controlled pneumatics with an intra-train communication network.
Figure 2:
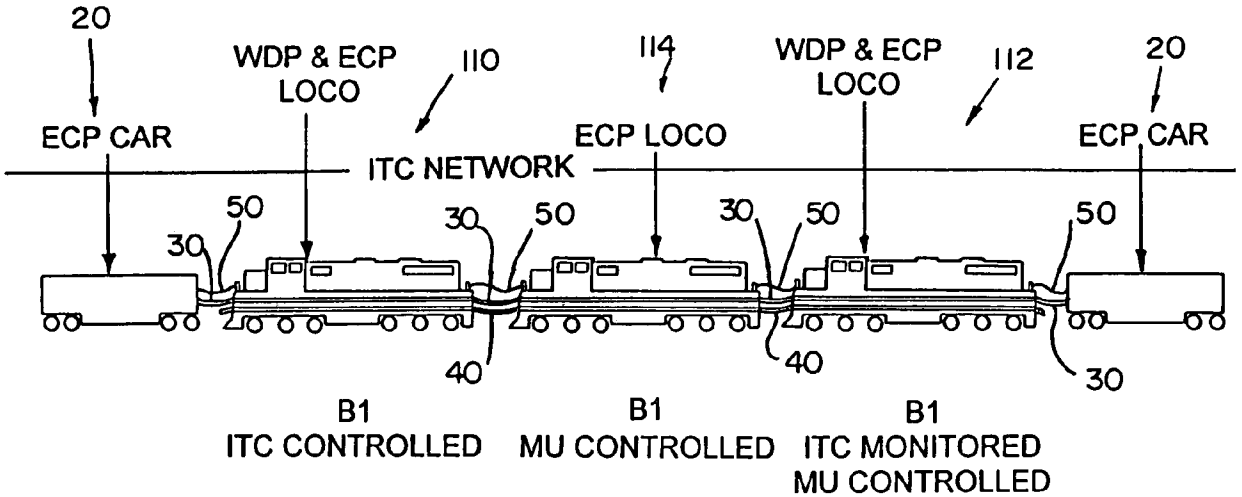
FIG. 2 is a modification of the B consist of FIG. 1.
Figure 3:
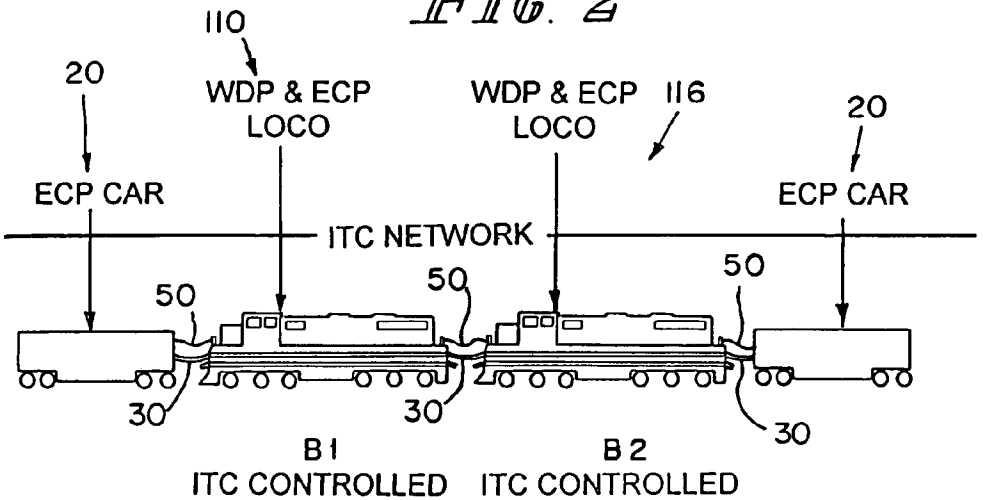
FIG. 3 is another modification of the B consist of FIG. 1.

A wired distributed power (WDP) train which includes electrically-controlled pneumatic (ECP) cars is illustrated in FIGS. 1–3 as reference numeral 10. The train 10 includes a first consist having an ITC lead locomotive 100 connected with an MU Controlled locomotive 102. Locomotive 100 is WDP and ECP equipped, and locomotive 102 is only ECP equipped. The ITC lead locomotive 100 is responsible for generating commands to and receiving information from other ITC equipped locomotives. The consist is interconnected by an intra-train communication (ITC) wire or cable 30, pneumatic hose 50 and an MU wire 40. As will be discussed, the ITC wire 30 and the pneumatic hose or pipe 50 run throughout the train. The first consist is connected by ITC line 30 and hose 50 to a plurality of ECP cars 20 represented by a single car.

A second consist including locomotives 110 and 112 is connected to the cars 20 by ITC line 30 and pneumatic hose 50. The first locomotive 110 is WDP and ECP equipped and will be considered ITC Controlled. An ITC Controlled unit is an ITC equipped locomotive, other than the lead locomotive, that is controlled by signals sent to it by the ITC lead locomotive via the ITC communication network. The ITC Controlled locomotive is responsible for controlling its MU consist based on the ITC lead commands. The ITC Controlled locomotive 110 is connected via ITC line 20, MU line 40 and hose 50 to a WDP and ECP locomotive 112. Locomotive 112 is considered an ITC Monitored and MU Controlled locomotive. The ITC Monitored locomotive is ITC equipped but MU Controlled. This locomotive 112 provides status information to the ITC lead locomotive via the ITC communication network.

The second consist 110, 112 is connected to a plurality of ECP cars 20 by the ITC line 30 and the hose 50. The last illustrated consist 120 includes a WDP and ECP equipped locomotive 120. It is connected to the cars 20 by the ITC line 30 and the hose 50.

As can be seen, FIG. 1 illustrates a train having vehicles which includes locomotives and cars. They are all connected in an ITC network. All of the vehicles in the train are ECP equipped and some, if not all, of the locomotives are WDP equipped. All of the consists are considered WDP consists in that they are MU consists that contain an ITC Controlled or ITC Monitored unit allowing the consist to be remotely controlled and/or monitored by the ITC lead unit 100.

According to the present disclosure, each locomotive of the consists will be given a first indicator indicating which consist it is in and a second indicator indicating what sub-consist it is in. A consist is defined as all adjacent locomotives separated from the other locomotives by at least one car. A sub-consist is defined as at least one locomotive not controlled by a preceding adjacent locomotive. This sub-consist results from two adjacent locomotives not being MU connected or controlled. An example is shown in FIG. 3 and will be discussed below. The consist indicator in one example of the present disclosure is signified by a letter and will also be referred to as a consist designator (CD). A sub-consist indicator is shown as a number and will also be referred to as a consist number (CN). Each locomotive is also assigned a configuration type (CT), which is either ITC Controlled or ITC Monitored. Although MU Controlled locomotives is a configuration type, it is not involved in the WDP, and therefore, it is not being listed. It should also be noted that if the consist designator, consist number or the configuration type cannot be determined, it is listed as unknown. Although letters and numbers are used as the consist indicator and the sub-consist indicator, respectively, any scheme or system may be used to distinguish a consist from a sub-consist. As shown in FIG. 1, there are three consists. The first consist including locomotives 101, 102 is assigned consist designator A; the second consist 110, 112 is consist designator B; and the third consist 120 is consist designator C. Since the A consist 100, 102 and the B consist 110, 112 are all MU Controlled consists, there is only a single, common sub-consist indicator 1 assigned to each. The third consist 120 has only a single locomotive and, therefore, it has a single, common sub-consist 1.

A modification of the second or B consist is illustrated in FIG. 2. It includes the WDP and ECP locomotive 110 separated from the WDP and ECP equipped locomotive 112 by an ECP-only equipped locomotive 114. All three of the locomotives are interconnected by an ITC line 30, an MU line 40 and a hose 50. Thus, as in FIG. 1, consist B is a single consist with no sub-consist. Thus, each locomotive 110, 112, 114 has a consist designator of B and a consist number of 1.

Another variation of the second or B consist is illustrated in FIG. 3. The first locomotive 110 is a WDP and ECP equipped locomotive connected to a WDP and ECP locomotive 116. Although the locomotives 110 and 116 are connected by the ITC line 30 and the hose 50, they are not connected by the MU line 40. This lack of connection generally comes about from incompatibility of the locomotives. Thus, locomotives 110, 116 both have a configuration type of ITC Controlled. This is to be distinguished from locomotive 112 in FIGS. 1 and 2 where it is ITC Monitored because it is in a common sub-consist with the ITC Controlled locomotive 110. Because locomotives 110 and 116 are not connected into an MU unit and they are both ITC Controlled, the first locomotive 110 has a consist designator of B and a consist number of 1, and the second locomotive 116 has a consist designator B and has a sub-consist or consist number 2. This is an indication that they are physically adjacent in a physical consist B, but they are in separately controlled sub-consists 1,2.

This allows appropriate separate control by the ITC lead locomotive 100 of the sub-consists 1 and 2 within the second physical consist B. Thus, although they have common consist designator or indicator, they have a separate consist number or indicator. If each of the locomotives 110, 116 included other locomotives in their sub-consists connected respectively thereto by the MU wire 40, each locomotive in the sub-consist 110 would be assigned consist indicator B1, and all locomotives in the consist of locomotive 116 would have consist indicator and sub-consist indicator B2.

Although the described example used letters as the consist designator and numerals as the sub-consist indicator, other schemes may be used. As long as there is some indication that there are different controllable consists that are adjacent to each other. For example in FIG. 1, the designations could be A1 for 100,102, B2 for 110,112 and C3 for 120. In FIG. 3, the total train would be A1 for 100,102, B2 for 110, C2 for 116, and D3 for 120. The middle consist 2 has two controllable sub-consists B and C.

In prior existing WDP make-up and linking processes which occur in the system initialization mode, the information provided to the lead LCM from the remote WDP equipped locomotives does not always accurately reflect physical consists or sub-consists with a physical consist. For example, in FIG. 2, in that the ECP only locomotive 114 is between two WDP locomotives 110, 112, the prior systems would have identified this as two separate consists, even though locomotive 112 is MU Controlled from locomotive 110. Also, as illustrated in FIG. 3, adjacent locomotives 110 and 116 are in the same physical consist but are in two separate sub-consists in that locomotive 116 is not MU Controlled by locomotive 110. The prior systems would have considered locomotives 110 and 116 a common consist in that two WDP locomotives are adjacent to each other. Thus, the present disclosure provides more accurate information of the locomotives within the train 10.

If the system would inaccurately reflect that locomotives 110 and 112 are in separate consists because of the presence of locomotive 114, the operator may attempt to provide a fence in the train between an apparent consist 110 or 112. A fence is a boundary established between WDP consists where the locomotive throttle and dynamic brake of the WDP consist on one side of the fence may be operated independently with respect to the throttle and dynamic brake of the WDP consist on the other side of the fence. In that the consist of locomotives 110, 112 and 114 are MU Controlled, this would be an inappropriate place to set a fence. With more accurate information, the system would prevent forming a fence in the middle of the physical consist of FIG. 2.

Figure 4:
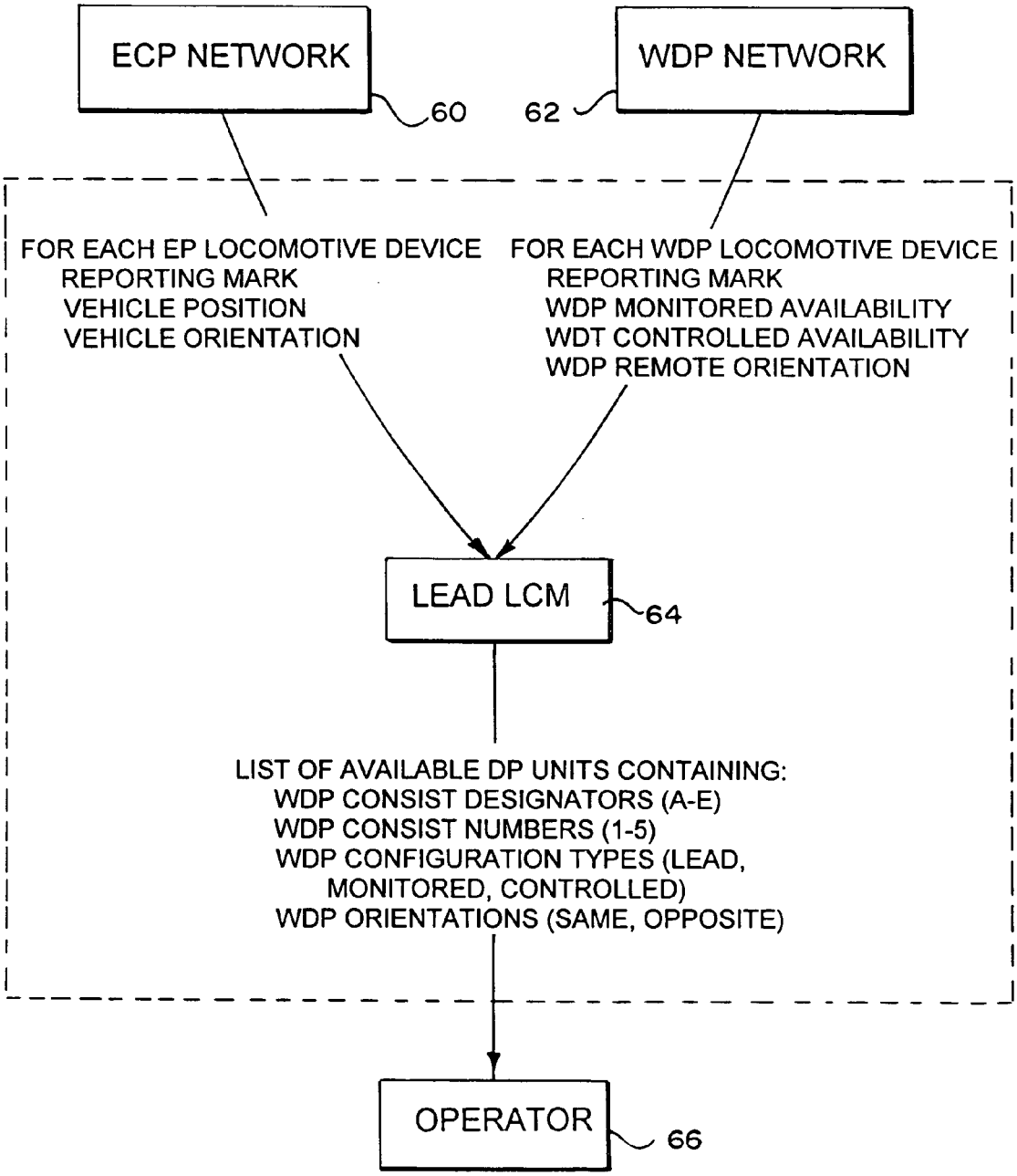
FIG. 4 is a block diagram of the inter-relationship between the ECP network, the WDP network and the lead locomotive.

As illustrated in FIG. 4, the train 10 includes software to define an ECP network 60 and a WDP network 62. All ECP devices in the train are on the ECP network 60. All WDP equipped devices are on the WDP network 62. Each of the networks provides the illustrated information in FIG. 4 to the lead LCM 64 over the ITC network.

The ECP network provides for each ECP device a reporting mark, a vehicle position and vehicle orientation. The reporting mark is an identification of the device. The vehicle position and orientation is determined using, for example, the method described in U.S. Pat. No. 6,049,296. Other systems may be used. The importance is that the information is derived for use in the present method.

The WDP network 62 provides for each WDP locomotive device the reporting mark, WDP Monitored Availability, WDP Controlled Availability and WDP Remote Orientation. The lead LCM 64 processes this information according to the present method to determine and assign consist designators, consist numbers, configuration type and WDP orientation. This information is presented to the operator at 66.

Figure 5:
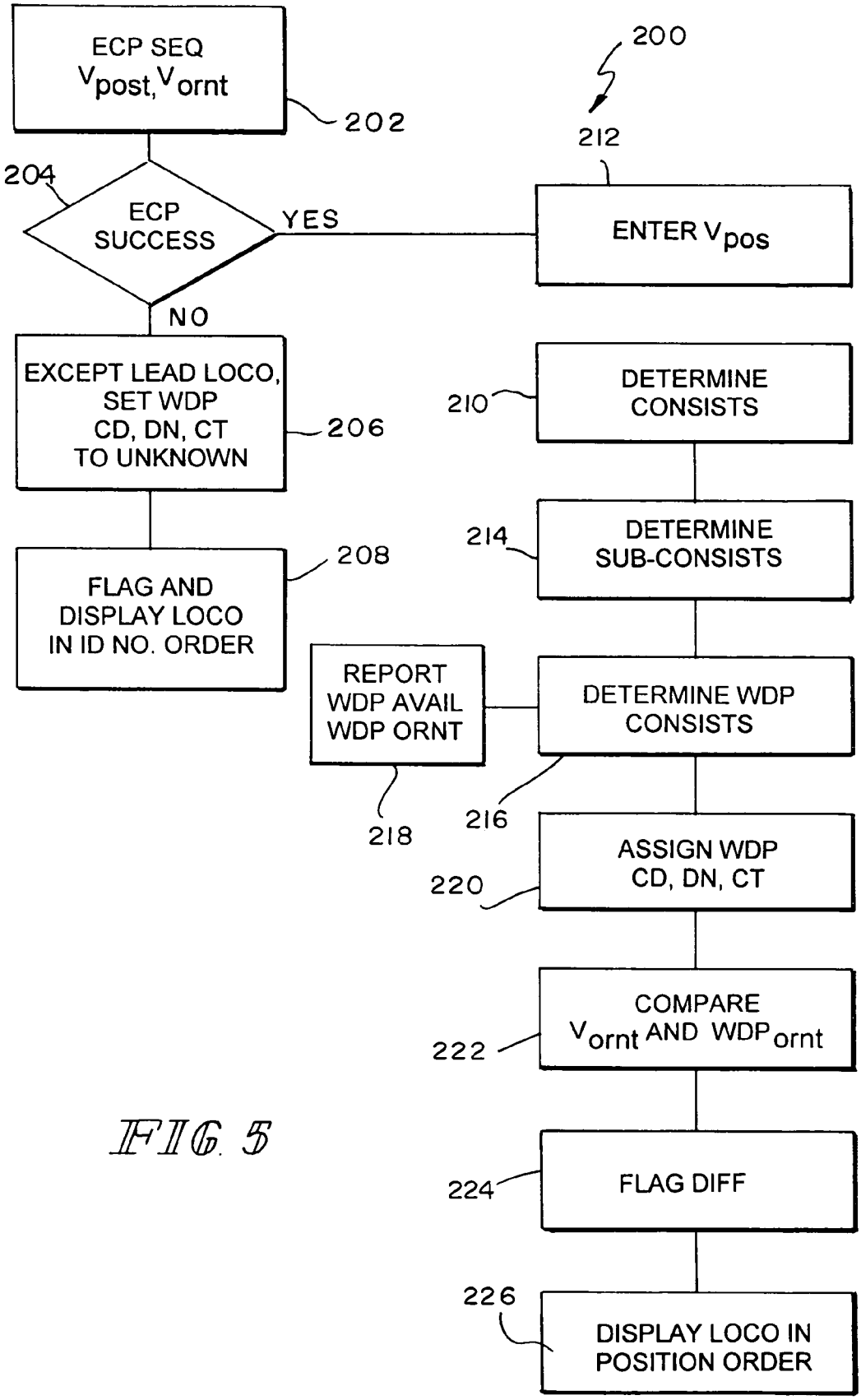
FIG. 5 is a flow chart of a method of determining the configuration of a locomotive in a wired distributed power train, according to the principles of the present disclosure.

The present method 200 is illustrated in FIG. 5. The ECP sequence is automatically performed at 202 to provide the vehicle position ($V_{post}$) and vehicle orientation ($V_{ornt}$). The ECP sequencing process is an automatic process derived off of the ECP network 60. A determination is made at 204 of whether the ECP sequencing process was successful. If not, the WDP consist designation (CD), consist number (CN) and configuration type (CT) are set to unknown, except for the lead locomotive at 206. This information is then flagged at 208. It also displays the locomotive in their ID or reporting mark order at 208 received from the WDP network 62.

If the ECP process is successful at 204, then there is a determination of what locomotives constitute a consist at 210. This uses the vehicle position ($V_{post}$) and the vehicle orientation ($V_{ornt}$) from the ECP sequencing process 202. If the ECP is not successful and it is desirable to perform the method otherwise, the vehicle positions can be manually entered at 212. Once a consist is determined from the vehicle position information at 210, there is also a determination of the sub-consists at 214. Next, there is a determination of whether the consist and sub-consist are WDP consists at 216. This is derived using the reported information of WDP availability from 218. A WDP consist is a consist which includes a WDP available device. Using this information, each WDP consist is assigned a consist designation (CD), a consist number (CN) and a configuration type (CT) at 220. The orientation information from the ECP process ($V_{ornt}$) and from the WDP process ($V_{ornt}$) is compared at 220. If there is a difference between these two orientations, it is flagged at 224. The information is then displayed in locomotive position order at 226.

The location information of all of the ECP devices in the train are used to determine adjacent locomotives throughout the train. This determines the physical consist. The sub-consist is determined also from adjacent locomotives and those locomotives which are not connected together in an MU unit because of incompatibility. One method to determine sub-consist is by monitoring the reporting mark received during the ECP network processing 60 or the WDP network processing 62. Knowing the specification of the locomotive by identification, compatibility of adjacent locomotives can be determined.

The assignment of WDP consist designation (CD) and consist number (CN) is sequential by position. For the orientation comparison at 222, if no orientation is presented for either $V_{ornt}$ or $WDP_{ornt}$, this is considered a difference and flagged. It should also be noted that while the $V_{ornt}$ by the ECP sequence is determined in that process, the WDP orientation $WDP_{ornt}$ is reported from the vehicle in the WDP network process 62.

As previously discussed, the present method will also prevent independent wired distributed power control of less than all sub-consists in a consist in response to an independent control request. This comes about by the ability to identify the sub-consist within a physical consist.

It should also be noted that all other controls performed by the lead LCM and outlined in the AAR specification are conducted within the present process. They are not illustrated, for sake of clarity, in FIG. 5. This includes controlling the LCM in the first locomotive in a consist to WDP Controlled and all other WDP locomotives in that sub-consist to a WDP Monitor.

Although the present method has been described and illustrated in detail, it is to be clearly understood that this is done by way of illustration and example only and is not to be taken by way of limitation. The scope of the present method is to be limited only by the terms of the appended claims.

What is claimed is:

1. A method for determining the configuration of locomotives in a wired distributed power train comprising:

determining consists of adjacent locomotives in the train;

determining one or more sub-consists of adjacent locomotives which are controlled separately from a preceding adjacent locomotive within the consist;

determining which locomotives have an available wired distributed power controller;

assigning a common consist indicator to all adjacent locomotives of a consist if the consist has at least one available wired distributed power controller; and assigning a common sub-consist indicator to all locomotives of a sub-consist if the sub-consist has at least one available wired distributed power controller.

2. The method according to claim 1, wherein determining a consist includes determining the position of cars and locomotives in the train.

3. The method according to claim 2, wherein the consist indicator is sequentially assigned based on position in the train.

4. The method according to claim 3, wherein the sub-consist indicator is sequentially assigned based on position in the consist.

5. The method according to claim 2, wherein the sub-consist indicator is sequentially assigned based on position in the consist.

6. The method according to claim 2, wherein the position in the train is determined automatically by determining the sequence of nodes connected to a wire network.

7. The method according to claim 2, wherein consists are determined from the positions of one locomotive or more than one adjacent locomotives separated by the position of at least one car.

8. The method according to claim 7, wherein sub-consists are determined from the position of one locomotive not controlled by a preceding adjacent locomotive.

9. The method according to claim 2, wherein sub-consists are determined from the position of one locomotive not controlled by a preceding adjacent locomotive.

10. The method according to claim 9, wherein a locomotive not controlled by a preceding adjacent locomotive is determined by comparing locomotive compatibility of adjacent locomotives.

11. The method according to claim 2, including determining a first orientation of the locomotives as part of the step of determining the position of the cars and locomotives in the train.

12. The method according to claim 11, wherein a second orientation of the locomotives are reported by the locomotives; and the first and second orientations for each locomotive are compared and difference in orientations are flagged.

13. The method according to claim 12, if a second orientation is not reported it is flagged.

14. The method according to claim 2, including displaying locomotive information including consist and sub-consist indicators in order of their position in the train.

15. The method according to claim 14, displaying locomotive information in numerical order of identification number of the locomotive if the position of the locomotives cannot be determined.

16. The method according to claim 1, including setting a first available distributed power controller in a sub-consist as the controlling controller of the sub-consist and setting other available distributed power controller in a sub-consist as the controlled controllers.

17. The method according to claim 1, wherein identification number of the locomotives is reported; wired distributed power capability of the locomotive as a function of its identification number is determined and compared to wired distributed power availability; and differences are flagged.

18. A method for determining the configuration of locomotives in a wired distributed power train comprising:

determining consists of adjacent locomotives in the train;

determining one or more sub-consists of adjacent locomotives which are controlled separately from a preceding adjacent locomotive within the consist;

determining which locomotives have an available wired distributed power controller;

assigning a common consist indicator to all adjacent locomotives of a consist if the consist has at least one available wired distributed power controller;

assigning a common sub-consist indicator to all locomotives of a sub-consist if the sub-consist has at least one available wired distributed power controller;

determining a first orientation of the locomotives;

wherein a second orientation of the locomotives are reported by the locomotives; and wherein the first and second orientations for each locomotive are compared and difference in orientations are flagged.

19. The method according to claim 18, if a second orientation is not reported it is flagged.

20. A method for determining the configuration of locomotives in a wired distributed power train comprising:

determining consists of adjacent locomotives in the train;

determining one or more sub-consists of adjacent locomotives which are controlled separately from a preceding adjacent locomotive within the consist;

determining which locomotives have an available wired distributed power controller;

assigning a common consist indicator to all adjacent locomotives of a consist if the consist has at least one available wired distributed power controller;

assigning a common sub-consist indicator to all locomotives of a sub-consist if the sub-consist has at least one available wired distributed power controller; and wherein a locomotive not controlled by a preceding adjacent locomotive is determined by comparing locomotive compatibility of adjacent locomotives.

21. A method for determining the configuration of locomotives in a wired distributed power train comprising:

determining consists of adjacent locomotives in the train;

determining one or more sub-consists of adjacent locomotives which are controlled separately from a preceding adjacent locomotive within the consist;

determining which locomotives have an available wired distributed power controller;

assigning a common consist indicator to all adjacent locomotives of a consist if the consist has at least one available wired distributed power controller;

assigning a common sub-consist indicator to all locomotives of a sub-consist if the sub-consist has at least one available wired distributed power controller; and preventing independent wired distributed power control of less than all sub-consists in a consist in response to an independent control request.

* * * * *